US007998577B2

(12) United States Patent
Rollin, Jr. et al.

(10) Patent No.: US 7,998,577 B2
(45) Date of Patent: Aug. 16, 2011

(54) MULTICOMPONENT FIBER WITH POLYARYLENE SULFIDE COMPONENT

(75) Inventors: Paul Ellis Rollin, Jr., Hendersonville, TN (US); Xun Ma, Midlothian, VA (US); Bruce A. Yost, Hendersonville, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 482 days.

(21) Appl. No.: 12/001,803

(22) Filed: Dec. 13, 2007

(65) Prior Publication Data

US 2009/0156075 A1 Jun. 18, 2009

(51) Int. Cl.
*D01F 8/00* (2006.01)

(52) U.S. Cl. ..... 428/373; 428/374

(58) Field of Classification Search ..... 428/373, 428/374, 370

See application file for complete search history.

(56) References Cited

U.S. PATENT DOCUMENTS

| | | | | |
|---|---|---|---|---|
| 4,942,091 | A * | 7/1990 | Umezawa et al. | 428/398 |
| 5,244,467 | A * | 9/1993 | Umezawa et al. | 8/115.69 |
| 5,405,695 | A * | 4/1995 | Akatsu et al. | 428/364 |
| 5,424,125 | A * | 6/1995 | Ballard et al. | 428/364 |
| 6,110,589 | A * | 8/2000 | Harwood et al. | 428/364 |
| 6,409,787 | B1 | 6/2002 | Smithies et al. | |
| 6,730,439 | B2 * | 5/2004 | Kamei et al. | 429/247 |
| 6,949,288 | B2 * | 9/2005 | Hodge et al. | 428/370 |
| 2004/0235383 | A1 * | 11/2004 | Perry et al. | 442/344 |
| 2005/0269011 | A1 * | 12/2005 | Auerbach et al. | 156/62.6 |
| 2008/0070021 | A1 * | 3/2008 | Rollin, Jr. | 428/219 |
| 2009/0156075 | A1 * | 6/2009 | Rollin et al. | 442/199 |

* cited by examiner

*Primary Examiner* — Arti Singh-Pandey

(57) ABSTRACT

This invention relates to a multicomponent fiber having an exposed outer surface, comprising at least a first component of polyarylene sulfide polymer, and at least a second component of a thermoplastic polymer free of polyarylene sulfide polymer, wherein said thermoplastic polymer forms the entire exposed surface of the multicomponent fiber.

28 Claims, 1 Drawing Sheet

MULTICOMPONENT FIBER WITH POLYARYLENE SULFIDE COMPONENT

BACKGROUND OF THE INVENTION

1. Field of the Invention

The present invention relates to fibers having a polyarylene sulfide component and products including the same.

2. Description of the Related Art

Filtration processes are used to separate compounds of one phase from a fluid stream of another phase by passing the fluid stream through filtration media, which traps the entrained or suspended matter. The fluid stream may be either a liquid stream containing a solid particulate or a gas stream containing a liquid or solid aerosol.

For example, filters are used in collecting dust emitted from incinerators, coal fired boilers, metal melting furnaces and the like. Such filters are referred to generally as "bag filters." Because exhaust gas temperatures can be high, bag filters used to collect hot dust emitted from these and similar devices are required to be heat resistant. Bag filters can also be used in chemically corrosive environments. Thus, dust collection environments can also require a filter bag made of materials that exhibit chemical resistance. Examples of common filtration media include fabrics formed of aramid fibers, polyimide fibers, fluorine fibers and glass fibers.

Polyphenylene sulfide (PPS) polymers exhibit thermal and chemical resistance. As such, PPS polymers can be useful in various applications. For example, PPS can be useful in the manufacture of molded components for automobiles, electrical and electronic devices, industrial/mechanical products, consumer products, and the like.

PPS has also been proposed for use as fibers for filtration media, flame resistant articles, and high performance composites. Despite the advantages of the polymer, however, there are difficulties associated with the production of fibers from PPS.

It is difficult to spin PPS fibers under continuous commercial process conditions as the PPS polymer tends to stick to the orifice of the spinneret nozzle causing a disruption of the fiber production. Eventually the nozzle becomes contaminated requiring the shut down of the equipment to address individual spinneret holes, the spinneret surface or to replace the spinneret altogether. It is well known that PPS has affinity for metal surfaces. This affinity is believed to be the underlying cause for poor spinning of PPS.

What is needed is a melt spinning process that can make PPS fibers that can be continuously spun with minimal disruption of the spinning process.

SUMMARY OF THE INVENTION

The present invention provides a commercially viable process to make multicomponent fiber with polyarylene sulfide content.

In a first embodiment, the present invention is directed to a multicomponent fiber having an exposed outer surface, comprising at least a first component of polyarylene sulfide polymer, and at least a second component of a thermoplastic polymer free of polyarylene sulfide polymer, wherein said thermoplastic polymer forms the entire exposed surface of the multicomponent fiber.

In other embodiments of the present invention the multicomponent fiber can be bicomponent or islands-in-the-sea types of fibers.

BRIEF DESCRIPTION OF THE DRAWINGS

Figure 1:
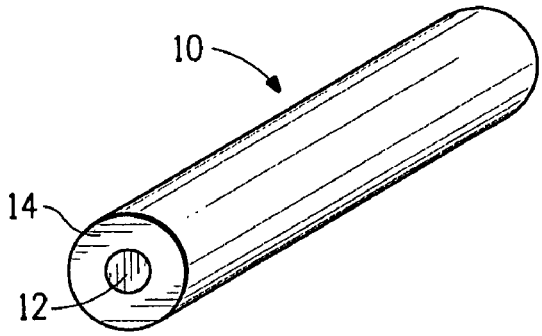
Figure 2:
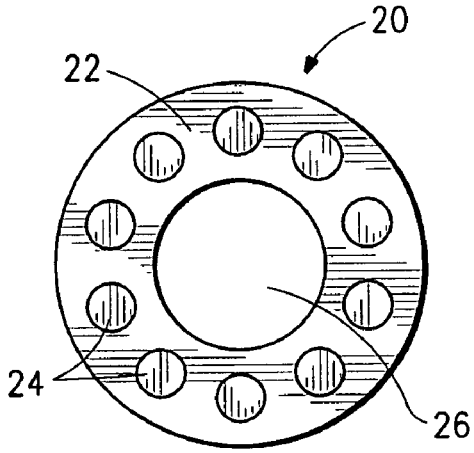
Figure 3:
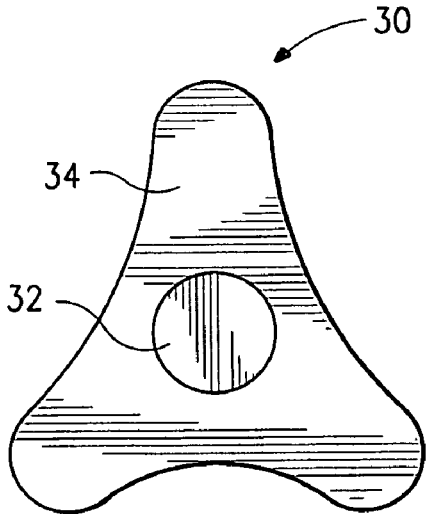

Having thus described the invention in general terms, reference will now be made to the accompanying drawings, which are not necessarily drawn to scale, and wherein:

FIG. 1 is a transverse cross sectional view of an exemplary multicomponent fiber of the invention, namely a bicomponent fiber;

FIG. 2 is a cross sectional view of another exemplary multicomponent fiber of the invention, namely an island-in-the-sea fiber; and FIG. 3 is a cross sectional view of another exemplary multicomponent fiber of the invention, namely a multilobal fiber.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As noted in the Background, PPS has affinity for metal surfaces, which is believed to be an underlying cause of its poor spinning characteristics. However, it has been discovered that co-spinning a second component of a thermoplastic polymer free of polyarylene sulfide around the entire exposed surface of the polyarylene sulfide component of the multicomponent fiber minimizes the plugging of the spinneret nozzles thereby extending the fiber spinning time before spinneret changes and producing a viable commercial spinning process. Furthermore, by minimizing the amount of thermoplastic polymer free of polyarylene sulfide around the entire exposed surface of the polyarylene sulfide component of the multicomponent fiber, it was surprisingly discovered that the multicomponent fiber continues to exhibit useful chemical and flame resistant properties similar to the polyarylene sulfide monocomponent fiber.

As used herein, the term "multicomponent fibers" includes staple fibers and continuous filaments prepared from two or more polymers present in discrete structured domains in the fiber, as opposed to blends where the domains tend to be dispersed, random or unstructured. The two or more structured polymeric components are arranged in substantially constantly positioned distinct zones across the cross section of the multicomponent fiber and extending continuously along the length of the multicomponent fiber.

For purposes of illustration only, the present invention will generally be described in terms of a bicomponent fiber comprising two components. However, it should be understood that the scope of the present invention is meant to include fibers with two or more structured components.

FIG. 1 is a transverse cross sectional view of an exemplary fiber configuration useful in the present invention. FIG. 1 illustrates a bicomponent fiber 10 having an inner core polymer domain 12 and surrounding sheath polymer domain 14. Sheath component 14 is formed of a thermoplastic polymer free of polyarylene sulfide polymer. Core component 12 is formed of polyarylene sulfide polymer. In the present invention, sheath 14 is continuous, e.g., completely surrounds core 12 and forms the entire outer surface of fiber 10. Core 12 can be concentric, as illustrated in FIG. 1. Alternatively, the core can be eccentric, as described in more detail below. Also, it should be recognized that due to processing variability, a small portion of the sheath could be contacted by the polyarylene sulfide polymer, however it is believed that there would only be minimal effect on spinning ability. Regardless, the sheath should be as virtually free of polyarylene sulfide polymer.

Other structured fiber configurations as known in the art can also be used, so long as the thermoplastic polymer free of polyarylene sulfide polymer forms the entire exposed outer surface of the fiber. As an example, another suitable multicomponent fiber construction includes "islands-in-the-sea" arrangements. FIG. 2 illustrates a cross sectional view of one such islands-in-the-sea fiber 20. Generally islands-in-the-sea fibers include a "sea" polymer component 22 surrounding a plurality of "island" polymer components 24. The island components can be substantially uniformly arranged within the matrix of sea component 22, such as illustrated in FIG. 2. Alternatively, the island components can be randomly distributed within the sea matrix.

Sea component 22 forms the entire outer exposed surface of the fiber and is formed of a thermoplastic polymer free of polyarylene sulfide polymer. As with core component 12 of sheath core bicomponent fiber 10, island components 24 are formed of polyarylene sulfide polymer. The islands-in-the-sea fiber can optionally also include a core 26, which can be concentric as illustrated or eccentric as described below. When present, core 26 is formed of any suitable fiber-forming polymer.

The fibers of the invention also include multilobal fibers having three or more arms or lobes extending outwardly from a central portion thereof. FIG. 3 is a cross sectional view of an exemplary multilobal fiber 30 of the invention. Fiber 30 includes a central core 32 and arms or lobes 34 extending outwardly therefrom. The arms or lobes 34 are formed of a thermoplastic polymer free of polyarylene sulfide polymer and central core 32 is formed of polyarylene sulfide polymer. Although illustrated in FIG. 3 as a centrally located core, the core can be eccentric.

Any of these or other multicomponent fiber constructions may be used, so long as the entire exposed outer surface of the fiber is formed of the thermoplastic polymer free of polyarylene sulfide polymer.

The cross section of the fiber is preferably circular, since the equipment typically used in the production of synthetic fibers normally produces fibers with a substantially circular cross section. In bicomponent fibers having a circular cross section, the configuration of the first and second components can be either concentric or acentric, the latter configuration sometimes being known as a "modified side-by-side" or an "eccentric" multicomponent fiber.

Advantageously, the sheath/core fibers of the invention are concentric fibers, and as such will generally be non-self crimping or non-latently crimpable fibers. The concentric configuration is characterized by the sheath component having a substantially uniform thickness, such that the core component lies approximately in the center of the fiber, such as illustrated in FIG. 1. This is in contrast to an eccentric configuration, in which the thickness of the sheath component varies, and the core component therefore does not lie in the center of the fiber. Concentric sheath/core fibers can be defined as fibers in which the center of the core component is biased by no more than about 0 to about 20 percent, preferably no more than about 0 to about 10 percent, based on the diameter of the sheath/core bicomponent fiber, from the center of the sheath component.

Islands-in-the-sea and multi-lobal fibers of the invention can also include a concentric core component substantially centrally positioned within the fiber structure, such as cores 26 and 32 illustrated in FIGS. 2 and 3, respectively. Alternatively, the additional polymeric components can be eccentrically located so that the thickness of the surrounding thermoplastic polymer free of polyarylene sulfide polymer component varies across the cross section of the fiber.

Any of the additional polymeric components can have a substantially circular cross section, such as components 12, 24 and 32 illustrated in FIGS. 1, 2 and 3, respectively. Alternatively, any of the additional polymeric components of the fibers of the invention can have a non-circular cross section.

Polyarylene sulfides include linear, branched or cross linked polymers that include arylene sulfide units. Polyarylene sulfide polymers and their synthesis are known in the art and such polymers are commercially available.

Exemplary polyarylene sulfides useful in the invention include polyarylene thioethers containing repeat units of the formula $—[(Ar^1)_n—X]_m—[(Ar^2)_i—Y]_j—(Ar^3)_k—Z]_l—[(Ar^4)_o—W]_p—$ wherein $Ar^1$, $Ar^2$, $Ar^3$, and $Ar^4$ are the same or different and are arylene units of 6 to 18 carbon atoms; W, X, Y, and Z are the same or different and are bivalent linking groups selected from $—SO_2—$, —S—, —SO—, —CO—, —O—, —COO— or alkylene or alkylidene groups of 1 to 6 carbon atoms and wherein at least one of the linking groups is —S—; and n, m, i, j, k, l, o, and p are independently zero or 1, 2, 3, or 4, subject to the proviso that their sum total is not less than 2. The arylene units $Ar^1$, $Ar^2$, $Ar^3$, and $Ar^4$ may be selectively substituted or unsubstituted. Advantageous arylene systems are phenylene, biphenylene, naphthylene, anthracene and phenanthrene. The polyarylene sulfide typically includes at least 30 mol %, particularly at least 50 mol % and more particularly at least 70 mol % arylene sulfide (—S—) units. Preferably the polyarylene sulfide polymer includes at least 85 mol % sulfide linkages attached directly to two aromatic rings. Advantageously the polyarylene sulfide polymer is polyphenylene sulfide (PPS), defined herein as containing the phenylene sulfide structure $—(C_6H_4—S)_n—$ (wherein n is an integer of 1 or more) as a component thereof.

At least one other of the polymeric components includes a polyester, polyamide or polyolefin polymer. Exemplary polyesters include without limitation aromatic polyesters, such as polyethylene terephthlate, aliphatic polyesters, such as polylactic acid, and mixtures thereof. Exemplary polyamides include Nylon 6 and Nylon 6,6. Exemplary polyolefins include without limitation polypropylene, polyethylene (low density polyethylene, high density polyethylene, linear low density polyethylene), and polybutene, as well as co- and terpolymers and mixtures thereof.

While mixtures of the polymers may be used, the at least one other polymeric component does not include a polyarylene sulfide polymer as defined above. This can reduce manufacturing costs and complexity. Yet surprisingly, despite the presence of a polymer which is not the same or chemically similar to the polyarylene sulfide polymer of the core polymeric component, the fibers of the invention exhibit sufficient integrity for downstream processing.

In one embodiment of the invention, the fiber-forming polymer can be an aliphatic polyester polymer, such as polylactic acid (PLA). Further examples of aliphatic polyesters which may be useful in the present invention include without limitation fiber forming polymer formed from (1) a combination of an aliphatic glycol (e.g., ethylene, glycol, propylene glycol, butylene glycol, hexanediol, octanediol or decanediol) or an oligomer of ethylene glycol (e.g., diethylene glycol or triethylene glycol) with an aliphatic dicarboxylic acid (e.g., succinic acid, adipic acid, hexanedicarboxylic acid or decaneolicarboxylic acid) or (2) the self condensation of hydroxy carboxylic acids other than polylactic acid, such as polyhydroxy butyrate, polyethylene adipate, polybutylene adipate, polyhexane adipate, and copolymers containing them. Aliphatic polyesters are known in the art and are commercially available.

In another advantageous embodiment of the invention, the fiber-forming component of the fibers of the invention can include an aromatic polyester polymer. Thermoplastic aromatic polymers include (1) polyesters of alkylene glycols having 2-10 carbon atoms and aromatic diacids; (2) polyalkylene naphthalates, which are polyesters of 2,6-naphthalenedicarboxylic acid and alkylene glycols, as for example polyethylene naphthalate; and (3) polyesters derived from 1,4-cyclohexanedimethanol and terephthalic acid, as for example polycyclohexane terephthalate. Polyalkylene terephthalates, especially polyethylene terephthalate (also PET) and polybutylene terephthalate, are particularly useful in various applications. Such polyesters are well known in the art and are commercially available.

The weight ratio of the respective polymeric components of the fibers of the invention can vary. For example, the weight ratio of the polymeric components can range from about 5:95 to about 95:5. One advantage of the fibers of the invention is that by using a minimal amount of thermoplastic polymer free of polyarylene sulfide polymer on the exposed surface of the fiber, there is minimal adverse impact on the desired properties of the fibers, such as chemical and heat resistance. In this regard, the thermoplastic polymer free of polyarylene sulfide component comprises less than about 30 percent by weight of the total weight of the fiber, more advantageously less than about 20 percent by weight of the total weight of the fiber and most advantageously less than about 10 percent by weight of the total weight of the fiber. For fiber end uses wherein the fiber performance is desired to be very close to a polyarylene sulfide monocomponent fiber, then the surface thermoplastic polymer free of polyarylene sulfide polymer component of the fiber should be minimized as much as possible.

The polymers can optionally include other components not adversely affecting the desired properties thereof. Exemplary materials that could be used as additional components would include, without limitation, antimicrobials, pigments, antioxidants, stabilizers, surfactants, waxes, flow promoters, solid solvents, particulates, and other materials added to enhance processability of the first and the second components. These and other additives can be used in conventional amounts.

Methods for making multicomponent fibers are well known and need not be described here in detail. Generally the multicomponent fibers of the invention are prepared using conventional multicomponent textile fiber spinning processes and apparatus and utilizing mechanical drawing techniques as known in the art. Processing conditions for the melt extrusion and fiber-formation of polyarylene sulfide polymers are well known in the art and may be employed in this invention. Processing conditions for the melt extrusion and fiber-formation of other fiber-forming polymers useful for the additional polymer component of the fibers are also known in the art and may be employed in this invention.

To form the multicomponent fiber of the invention, at least two polymers, namely, a polyarylene sulfide polymer and at least one additional fiber-forming polymer are melt extruded separately and fed into a polymer distribution system wherein the polymers are introduced into a spinneret plate. The polymers follow separate paths to the fiber spinneret and are combined in a spinneret hole. The spinneret is configured so that the extrudant has the desired shape.

Following extrusion through the die, the resulting thin fluid strands, or filaments, remain in the molten state before they are solidified by cooling in a surrounding fluid medium, which may be chilled air blown through the strands, or immersion in a bath of liquid such as water. Once solidified, the filaments are taken up on a godet or another take-up surface. In a continuous filament process, the strands are taken up on a godet which draws down the thin fluid streams in proportion to the speed of the take-up godet. In the jet process, the strands are collected in a jet, such as for example, an air gun, and blown onto a take-up surface such as a roller or a moving belt to form a spunbond web. In the meltblown process, air is ejected at the surface of the spinneret, which serves to simultaneously draw down and cool the thin fluid streams as they are deposited on a take-up surface in the path of cooling air, thereby forming a fiber web.

Regardless of the type of melt spinning procedure which is used, the thin fluid streams are melt drawn down in a molten state, i.e. before solidification occurs to orient the polymer molecules for good tenacity. Typical melt draw down ratios known in the art may be utilized. Where a continuous filament or staple process is employed, it may be desirable to draw the strands in the solid state with conventional drawing equipment, such as, for example, sequential godets operating at differential speeds.

Following drawing in the solid state, the continuous filaments may be crimped or texturized and cut into a desirable fiber length, thereby producing staple fiber. The length of the staple fibers generally ranges from about 25 to about 50 millimeters, although the fibers can be longer or shorter as desired.

The fibers, of the invention are useful in the production of a wide variety of products, including without limitation nonwoven structures, such as but not limited to carded webs, wet laid webs, dry laid webs, spunbonded webs, meltblown webs, and the like. The fibers of the invention can also be used to make other textile structures such as but not limited to woven and knit fabrics. Fibers other than the fibers of the invention may be present in articles produced therefrom, including any of the various synthetic and/or natural fibers known in the art. Exemplary synthetic fibers include polyolefin, polyester, polyamide, acrylic, rayon, cellulose acetate, thermoplastic multicomponent fibers (such as conventional sheath/core fibers, for example polyethylene sheath/polyester core fibers) and the like and mixtures thereof. Exemplary natural fibers include wool, cotton, wood pulp fibers and the like and mixtures thereof.

In one particularly advantageous aspect of the invention, the fibers are used as to produce filtration media. In this embodiment, the fibers of the invention can exhibit good thermal and chemical resistance. The fibers can also exhibit good flexibility and tensile strength and can be manipulated to produce products for use in corrosive and/or high temperature environments. For example, the fibers of the invention can be readily processed to produce products for use as filtration media, such as bag filters (or bag-house filters) for collecting hot dust generated by incinerators, coal fired boilers, metal melting furnaces and the like. Another use for the fibers of the invention is the production of insulation for hot oil transformers.

Test Methods

The Flammability (NFPA-702-1980) test was used as a basis for our study. This test is primarily concerned with wearing apparel and it measures the flame resistance of materials when they are in contact with a source of ignition. A standardized flame is impinged on the lower edge of a 6.4× 15.2 cm specimen mounted at a 45 degree angle. In our modification, the flame was applied until the sample ignited. What was then measured was ignition time and total burn time in seconds. The burn length was recorded in cm.

EXAMPLES

The present invention will be further illustrated by the following non-limiting examples.

Comparative Example A

In this example, a bicomponent spunbond fabric was made from polyphenylene sulfide component. The polyphenylene sulfide component has a nominal melt viscosity of 1700 Poise at 1200 $s^{-1}$ and at a temperature of 316° C. The resin is available from Ticona as Fortron PPS 0317 C1. The polyphenylene sulfide resin was dried in a through air dryer at a temperature of 115° C., to a moisture content of less than 150 parts per million. The polymer was heated in separate extruders to 295° C. The polymer streams were metered to a spin-pack assembly where the two melt streams were separately filtered and then combined through a stack of distribution plates to provide multiple rows of spunbond fibers having sheath-core cross sections. The PPS component comprised both the sheath and core components.

The spin pack assembly consisted of 4316 round capillary openings (155 rows where the number of capillaries vary from 22 to 28). Each capillary has a diameter of 0.35 mm and a length of 1.40 mm. The width of the pack in the MD direction was 18.02 and in the cross direction was 115.09 cm. The spin-pack assembly was heated to 295° C. and the polymers were spun through each capillary at a polymer throughput rate of 1.0 g/hole/min. The fibers were cooled in a cross flow quench extending over a length of 122 cm. An attenuating force was provided to the bundle of fibers by a rectangular slot jet. The distance from the between the spin-pack to the entrance of the jet was 83.82 cm. The fibers exiting the jet were collected on a forming belt. A vacuum was applied underneath the belt to help pin the fibers to the belt. The spunbond layer was then thermally bonded between an embosser roll and an anvil roll. The bonding conditions were 148° C. roll temperature and 300 PLI nip pressure. After thermal bonding, the spunbond sheet was formed into a roll using a winder.

Attempts to produce Comparative Example A were met with great difficulty. Within minutes of start up the spinneret surface would need to be scraped to remove any residue that had initially formed. Scraping the surface of the spinneret was often repeated on an hourly basis. The presence of un-attenuated polymer in the sheet, jet obstruction by fibrous and non-fibrous material, and forming belt contamination by molten polymer were the type of spinning defects that were often observed which led to taking the process offline to address the contaminated spinneret surface. Many of these defects would also lead to bonder wraps and sheet breaks which would also require that the process be taken offline to address, Flame resistant performance data are listed in the Table.

Example 1

In this example, a bicomponent spunbond fabric was prepared as described in Comparative Example A with the exception that the fibers consisted of a poly(ethylene terephthalate) component and a poly(phenylene sulfide) component. The polyester component has an intrinsic viscosity of 0.53 dl/g available from DuPont as Crystar® polyester (Merge 4415). The polyphenylene sulfide component has a nominal melt viscosity of 1700 Poise at 1200 $s^{-1}$ and at a temperature of 316° C. The resin is available from Ticona as Fortron PPS 0317 C1. The polyester resin was dried in a through air dryer at a temperature of 120° C., to a moisture content of less than 50 parts per million. The polyphenylene sulfide resin was dried in a through air dryer at a temperature of 115° C., to a moisture content of less than 150 parts per million. The polymers were heated in separate extruders with the polyester heated to 290° C. and the polyphenylene sulfide resin heated to 295° C. The two polymers were metered to a spin-pack assembly where the two melt streams were separately filtered and then combined through a stack of distribution plates to provide multiple rows of spunbond fibers having a sheath-core cross sections. The PPS component comprised the core and the PET component comprised the sheath. The polyester component consisted of 10% by weight of the spun bond fibers.

Example 1 was prepared while maintaining a defect free spinning process. In fact, once process conditions were set for Example 1, the process ran for more than 3 hours without need for shutdown or operator involvement. Once the requisite product was produced the production of Example 1 was discontinued. It was found that the spinneret surface was free of contamination or monomer residue during that time.

Flame resistant performance data are listed in the Table.

Example 2

Example 2 was prepared similarly to Example 1 except the PET component was 15%.

Example 2 was prepared while maintaining a defect free spinning process. The process ran for more than 3 hours without need for shutdown or operator involvement. Once the requisite product was produced the production of Example 2 was discontinued. It was found that the spinneret surface was free of contamination or monomer residue during that time.

Flame resistant performance data are listed in the Table.

Example 3

Example 3 was prepared similarly to Example 1 except the PET component was 20%.

Example 3 was prepared while maintaining a defect free spinning process. The process ran for more than 3 hours without need for shutdown or operator involvement. Once the requisite product was produced the production of Example 3 was discontinued. Separately, an effort was made to demonstrate process continuity as it relates to Example 3. The process was brought online and permitted to run for more than 7 hours without interruption. Examination of the spinneret surface revealed that it was substantially free of contamination or monomer residue.

Flame resistant performance data are listed in the Table.

Example 4

Example 4 was prepared similarly to Example 1 except the PET component was 25%.

Example 4 was prepared while maintaining a defect free spinning process. The process ran for more than 3 hours without need for shutdown or operator involvement. Once the requisite product was produced the production of Example 4 was discontinued. It was found that the spinneret surface was free of contamination or monomer residue during that time.

Flame resistant performance data are listed in the Table.

Example 5

Example 5 was prepared similarly to Example 1 except the PET component was 50%.

Example 5 was prepared while maintaining a defect free spinning process. The process ran for more than 3 hours without need for shutdown or operator involvement. Once the requisite product was produced the production of Example 5 was discontinued. It was found that the spinneret surface was free of contamination or monomer residue during that time.

Flame resistant performance data are listed in the Table.

Example 6

Example 6 was prepared similarly to Example 1 except the PET component was 75%.

Example 6 was prepared while maintaining a defect free spinning process. The process ran for more than 3 hours without need for shutdown or operator involvement. Once the requisite product was produced the production of Example 6 was discontinued. It was found that the spinneret surface was free of contamination or monomer residue during that time.

Flame resistant performance data are listed in the Table.

Without wishing to be bound by theory, it is believed that insulating the PPS melt from the metal surfaces of the spin pack assembly with the PET composing the sheath prevented PPS residues from building up at the exit edge of the capillaries and on the surface of the spinneret. This allows the spinning process to run for a longer amount of time without operator involvement or process shutdown for making a sheath/core PET/PPS spunbond fiber over a PPS only spunbond fiber.

TABLE

FIBER FLAME RESISTANCE PERFORMANCE

| Example | Exposed PET Surface Component (% by weight) | Burn Length (cm) | Burn Time in MD (s) | Burn Ignition Time (s) |
|---|---|---|---|---|
| A | 0 | 2.8 | 2.5 | 0.65 |
| 1 | 10 | 3.0 | 2.4 | 0.79 |
| 2 | 15 | 3.0 | 4.1 | 0.98 |
| 3 | 20 | 2.5 | 3.5 | 0.63 |
| 4 | 25 | 3.6 | 6.8 | 0.70 |
| 5 | 50 | 3.8 | 8.5 | 0.90 |
| 6 | 75 | 8.9 | 17.6 | 0.95 |

These flame resistant performance data show that the bicomponent fiber with an exposed surface component of polyester has properties that are in fact similar to those of the 100% PPS fibers, especially where the exposed PET sheath component represents a small percentage of the fibers total weight.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A multicomponent fiber having an exposed outer surface, comprising:

at least a first component of polyarylene sulfide polymer; and at least a second component of a thermoplastic polymer free of polyarylene sulfide polymer, wherein said thermoplastic polymer forms the entire exposed surface of the multicomponent fiber.

2. The fiber of claim 1, wherein said polyarylene sulfide polymer comprises a polymer in which at least 85 mol % of the sulfide linkages are attached directly to two aromatic rings.

3. The fiber of claim 2, wherein said polyarylene sulfide polymer is polyphenylene sulfide.

4. The fiber of claim 1, wherein said thermoplastic polymer is selected from the group consisting of polyesters, polyamides and polyolefins.

5. The fiber of claim 1, wherein said polyester is selected from the group consisting of aromatic polyesters, aliphatic polyesters, and mixtures thereof.

6. The fiber of claim 5, wherein said aromatic polyester is selected from the group consisting of polyalkylene terephthalates, polyalkylene naphthalates, polyesters derived from cyclohexanedimethanol and terephthalic acid, and mixtures thereof.

7. The fiber of claim 6, wherein said aromatic polyester is selected from the group consisting of polyethylene terephthalate, polybutylene terephthalate, polyethylene naphthalate, polycyclohexane terephthalate, and mixtures thereof.

8. The fiber of claim 7, wherein said aromatic polyester is polyethylene terephthalate.

9. The fiber of claim 5, wherein said polyester is an aliphatic polyester.

10. The fiber of claim 9, wherein said aliphatic polyester is polylactic acid.

11. The fiber of claim 4, wherein said polyamide is selected from the group consisting of nylon 6, nylon 6, 6, mixtures and copolymers thereof.

12. The fiber of claim 4, wherein said polyolefin is selected from the group consisting of polypropylene, low density polyethylene, high density polyethylene, linear low density polyethylene, polybutene, mixtures and copolymers thereof.

13. The fiber of claim 1, wherein the second component comprises less than about 30 percent by weight of the total weight of the fiber.

14. The fiber of claim 13, wherein the second component comprises less than about 20 percent by weight of the total weight of the fiber.

15. The fiber of claim 14, wherein the second component comprises less than about 10 percent by weight of the total weight of the fiber.

16. The fiber of claim 1, wherein said fiber has a circular cross section.

17. The fiber of claim 1, wherein said fiber has a multi-lobal cross section.

18. The fiber of claim 1, wherein said fiber is a continuous filament.

19. The fiber of claim 1, wherein said fiber is a staple fiber.

20. The fiber of claim 1, wherein said fiber is a spunbond fiber.

21. The fiber of claim 1, wherein said fiber is a meltblown fiber.

22. The fiber of claim 1, wherein said fiber is a bicomponent fiber comprising a sheath component and a core component, wherein said sheath component forms the entire exposed outer surface of said fiber and comprises said thermoplastic polymer free of polyarylene sulfide polymer, and wherein said core component comprises polyarylene sulfide polymer.

23. The fiber of claim 22, wherein said bicomponent fiber has a concentric sheath/core cross section.

24. The fiber of claim 22, wherein said bicomponent fiber has an eccentric sheath/core cross section.

25. The fiber of claim 1, wherein said fiber is an islands-in-the-sea fiber comprising a sea component and a plurality of island components distributed within said sea component, wherein said sea component forms the entire exposed outer surface of said fiber and comprises said thermoplastic polymer free of polyarylene sulfide polymer, and wherein said plurality of island components comprises polyarylene sulfide polymer.

26. A web comprising the fiber of claim 1.

27. The web of claim 26, wherein the web comprises a woven or nonwoven material.

28. The web of claim 26, wherein the web is made from a spunbond or meltblown process.

* * * * *